US008726825B2

(12) United States Patent
Gai et al.

(10) Patent No.: US 8,726,825 B2
(45) Date of Patent: May 20, 2014

(54) SERVO-ASSISTED STEERING DEVICE FOR VEHICLES, IN PARTICULAR FOR BOATS OR THE LIKE

(75) Inventors: Marcella Gai, Casella (IT); Enrico Pagani, Casella (IT)

(73) Assignee: Ultraflex S.p.A., Casella (GE) (IT)

( * ) Notice: Subject to any disclaimer, the term of this patent is extended or adjusted under 35 U.S.C. 154(b) by 409 days.

(21) Appl. No.: 13/117,948

(22) Filed: May 27, 2011

(65) Prior Publication Data

US 2012/0132120 A1 May 31, 2012

(30) Foreign Application Priority Data

May 28, 2010 (IT) ..... GE2010A0060

(51) Int. Cl.
*B63H 25/22* (2006.01)

(52) U.S. Cl.
USPC ..... 114/144 RE; 60/431; 114/150

(58) Field of Classification Search
USPC ..... 114/150; 440/1, 61 S; 60/400, 431
See application file for complete search history.

(56) References Cited

U.S. PATENT DOCUMENTS

| | | | | |
|---|---|---|---|---|
| 5,146,745 | A | 9/1992 | Doetsch | |
| 7,318,386 | B2 * | 1/2008 | Dudra et al. | 114/150 |
| 2006/0063441 | A1 | 3/2006 | Saito | |
| 2009/0282823 | A1 | 11/2009 | Redfern | |

FOREIGN PATENT DOCUMENTS

| | | |
|---|---|---|
| EP | 1889781 | 2/2008 |

* cited by examiner

*Primary Examiner* — Edwin Swinehart
(74) *Attorney, Agent, or Firm* — Themis Law

(57) ABSTRACT

A servo-assisted steering device for vehicles includes a manual control member that is connected to a pump or the like manually driving it when the control member is rotated. The pump is connected at its delivery and suction side to one of the two chambers of one or more steering actuators through hydraulic pipes, feeding a pressurized fluid alternately to one or the other of the two chambers depending on moving direction, in particular the rotation of the control member. Assist control means for the steering actuators include a hydraulic fluid tank and automatic pumping means, which are driven and connected to the hydraulic pipes when the steering wheel is operated and which, by increasing the amount of pumped fluid, increase the pressure exerted by the pump to reduce resistance when steering the control member. The number of revolutions of the motor driving the automatic pumping means may be adjusted.

14 Claims, 2 Drawing Sheets

SERVO-ASSISTED STEERING DEVICE FOR VEHICLES, IN PARTICULAR FOR BOATS OR THE LIKE

FIELD OF THE INVENTION

The present invention relates to a servo-assisted steering device for vehicles, in particular for boats or the like, which includes a manual control member, such as a steering wheel or the like, that is connected to a shaft driving a pump and manually drives it when the control member is rotated. The pump has its delivery and suction side connected to one of the two chambers of one or more steering actuators, such as a double-acting hydraulic cylinder or the like through hydraulic pipes, such to supply a pressurized fluid alternately to either one or the other of the two chambers of the actuator or actuators depending on the direction in which the control member is rotated.

Assist control means for the steering actuators are also connected to the connection hydraulic pipes. The assist means include a hydraulic fluid tank and automatic powered pumping means, which are driven by at least a motor and are driven and connected to the hydraulic pipes when the steering wheel is operated. The automatic pumping means, by increasing the amount of pumped fluid, increase the pressure exerted by the manual pumping means to reduce resistance when steering the manual control means.

BACKGROUND OF THE INVENTION

Steering systems currently used include means for assisting the manual pumping means and are generally composed of manual control means, such as a steering wheel or the like, which operate the pumping means in order to move a steering actuator. Steering assist means are generally based on automatically operated pumping mechanical means, which are hydraulically connected to manual pumping means and which are operated by using measurements of the conditions of the pressurized fluid. Generally, automatic pumping means are based only on the operation of the manual control means, for example, the assist means pump an amount of fluid proportional to steering wheel rotation, without considering navigation conditions, such as for example cruising speed or the number of revolutions of the propulsion engine.

Moreover, assist means are generally operated automatically. At present there are no servo-assisted steering devices that can be operated both automatically and manually and that contemporaneously adjust or set the amount of fluid to be pumped into the assist hydraulic circuit.

Therefore, there is an unsatisfied need for a servo-assisted steering device which, by means of relatively simple and inexpensive arrangements, facilitates maneuvers during use of the vehicle to which the device is associated. A solution to that need involves the use of steering assist means, which can be adjusted both manually and automatically during operation, based, among other things, on the navigation conditions of the vehicle to which the device is associated.

SUMMARY OF THE INVENTION

The invention achieves the above aims by providing a servo-assisted steering device that includes means for setting the number of revolutions of the motor driving the automatic powered pumping means, which control and/or modify the number of revolutions of the driving motor.

In particular, the manual pump can be a manually operated piston pump, such as that described in SV2005A000011, or a pump of the type called Gerotor, manufactured according to patent application SV2002A000031, or any other type.

In one embodiment, means for setting/changing the number of revolutions of the electric motor driving the pumping means are composed of at least one member for manually entering a command setting/changing the number of revolutions of the electric motor driving the pumping means and of a control unit that generates power supply signals for said electric motor, which correspond to the entered command setting/changing the number of revolutions of the electric motor.

Several structural arrangements of the means for entering the setting/changing commands are possible and can be provided both alternately or in combination one with the other.

In a simpler and more economic arrangement, the at least one member for manually entering a command setting/changing the number of revolutions of the electric motor driving the pumping means is a switching member that feeds to the control unit one of two different commands setting/changing the number of revolutions depending on switching condition.

A variant provides the at least one member for manually entering a command setting/changing the number of revolutions of the electric motor driving the pumping means to be a slide member that feeds to the control unit a different command setting/changing the number of revolutions in a continuous progression depending on the position of the slide with reference to the entire stroke thereof.

In a further variant, the at least one member for manually entering a command setting/changing the number of revolutions of the electric motor driving the pumping means is a selector member with several switching positions, each feeding to the control unit a command setting/changing the number of revolutions, which is different than that fed in the other switching positions.

In a first embodiment, the electric motor used within the assist means for operating the automatic mechanical pumping means is a "brushless" motor provided in combination with a control unit for the number of revolutions of the motor, which has in addition means for setting and changing the number of revolutions, that is, it can receive signals and consequently set the number of revolutions of the "brushless" motor. The use of a "brushless" type motor provides several advantages for a device according to the present invention, for example, the expected life of the motor lasts longer than direct current electric motors, which have the drawback of the wear of the brushes. That is not the case for "brushless" motor, moreover the fact that brushes are not provided leads to the suppression of the main source of electromagnetic noise, which is present within common direct current motors. Finally, with the same delivered power the overall dimensions of a "brushless" motor are smaller than a direct current electric motor and such type of motor generates less heat than an alternate current motor and allows generated heat to be dissipated in a better way. Moreover, with the "brushless" motor it is possible to control the number of revolutions and consequently the power delivered by the motor without reducing the delivered mechanical torque. Thus, it is possible to decide the amount of fluid to be pumped by the automatic pumping means for assisting the manual pumping means, in order to facilitate the steering action independently from the operating condition such that the operation is always achieved.

On the contrary, the use of a brushless motor involves greater costs and more complex control electronics that can be custom-made for each application.

In another embodiment, a conventional brush motor is employed in combination with a power signal generator circuit composed of a PWM modulator (Pulse Width Modulator), which transforms the direct current power signal into a sequence of pulses that are modulated in width and not in amplitude. Such modulation type has the advantages of requiring simple, inexpensive and very reliable electronics. Moreover, the electric motor is not affected by the PWM power supply, on the contrary has positive effects on the wear, heating and therefore operating conditions of the motor.

In still another embodiment, the steering device of the present invention is composed of a manual control member connected, by its driving shaft, to conversion means which are operated by the driving shaft and which transform the rotational movement of the control member into electric signals that correspond to the direction and rotation angle of the driving shaft of the control member and/or of the control member.

In this case, the conversion means are electronically connected to the control unit, described above, of the control assist means. The control unit receives input electric signals sent by conversion means. On the basis of those signals, the unit sets the number of revolutions of the electric motor which drives the above described pump, in communication with a tank.

By means of hydraulic pipes, the pump has its delivery and suction connected to one of the two chambers respectively of a double-acting hydraulic cylinder. Depending on the direction of the rotation of the control member, with the hydraulic pipes, the pump feeds alternately the two chambers of the linear actuator, with a pressurized fluid contained within the tank.

Since output signals from the conversion means depend on the rotation of the control member, consequently the control unit will set the number of revolutions of the motor on the basis of the rotation level of the steering wheel.

Preferably, the conversion means comprise a sensor which transforms the rotational movement of the control member into electric signals to be sent to a digital electronic component, of the encoder type or the like, which converts the electric signals into digital data to be sent to the control unit.

Moreover, the conversion means may be made, for example, as described in published European patent application EP 1889781 to the same applicant, where such means are described in details.

The utility of changing the number of revolutions of the motor is shown by the fact that with a device according to the present invention the power can be delivered by the motor in two different manners, both manually and automatically.

The control unit of the electric motor may be electrically connected to a manual control such as a slide, rotating knob, oscillating lever or the like, in combination with an active or passive element, such as a potentiometer or the like, generating a signal to be transmitted to the control unit of the motor driving the pumping means, in order to change and set the number of revolutions of the motor.

Moreover, in another embodiment of a device according to the present invention, the signal is generated by a controller connected to the control unit, in order to automatically change the number of revolutions of the motor based on parameters concerning the navigation.

In this case, there are provided means in communication with the controller for setting such parameters, which can be composed of mechanical members provided in combination with sensors intended for reading and detecting the operating conditions of such mechanical members and for translating such conditions into electric signals to be sent to the controller.

In addition, there are provided power supply means for the entire system, which are composed of a power generating and storing source, of the battery type or the like, and of matching circuits for the communication of the power generating and storing source with the controller and with the control unit.

In one embodiment, a cutoff device may be provided for opening and closing the circuit electrically connecting the battery and the control unit and the controller.

As it will be described below, such signals will be then processed by the controller, therefore, a variant embodiment of a device according to the present invention provides for the use of means for operating/disabling the control unit and the controller, which are preferably composed of at least a push button switch, placed between the power cutoff device and control unit and the controller. Such push button switch has two conditions, one of which is an operating condition and the other one is a disabling condition, and has an electronic control unit such that the control unit and the controller are operated or disabled depending on the operating/disabling condition of the push button switch.

The operating/disabling condition of the push button switch is defined by the control electronics, which controls the opening or closing of the power supply circuit, and with the power supply circuit in the closed condition allow the switch to be operated by a manual control.

Advantageously, if there is no power supply the control electronics automatically sets the push button switch in the disabling condition without the manual control.

Once the push button switch is set in the operating condition, it operates the controller and enables it to read the signal sent by sensor means, namely to receive at least one parameter concerning the navigation, to process such parameter, and a signal defining the amount of power to be delivered is sent to the control unit, which is also operated by the push button switch, of the motor such to define the number of revolutions of the motor.

In one embodiment, the controller includes processor means executing a logic program for processing signals from one or more sensors and/or from the means manually setting/changing the number of revolutions of the electric motor, giving a "weighting" coefficient to parameter values of said input signals such to give an order of importance thereto and consequently to set the power delivered by the motor.

Moreover, means may be provided for setting priority criteria for signals setting/changing the number of revolutions of the motor driving the pumping means, and depending on where such signals come from, they intercept the signals coming from low priority units and stop them, such that only the ones having a higher priority are transmitted to the controller.

It is possible to provide priority hierarchies, according to which the control signal fed to the controller is always the one coming from the means generating it at that current moment and having the highest priority.

An improvement of the logic program executed by the above described controller provides not only a "weighting" coefficient for the individual parameters concerning the navigation, but also the use of correlation functions for signals setting/changing the number of revolutions of the motor and input parameters received by sensor means, such to adjust the following signals setting/changing the motor power both on the basis of parameters concerning the navigation, and on the basis of the operating conditions of the motor.

A device according to the present invention provides also for the use of operating means acting on the power supply of the electric motor, of the pump and of the controller, such that they are in a position of minimum consumption, where the controller sends to the control unit of the motor a signal changing/setting a predetermined number of revolutions corresponding to a minimum number of revolutions that guarantee an initial steering assist level. Then, upon the operation by a manual control switching the push button, the controller generates a signal changing/setting the number of revolutions of the electric motor, which corresponds to a greater number of revolutions and guaranteeing a higher steering assist level with respect to the minimum number of revolutions. The electronic controller is operated contemporaneously with the generation of signals changing/setting the number of revolutions of the motor on the basis of signals transmitted by the one or more sensors of one or more control members.

In on embodiment, the signal changing/setting the number of revolutions of the motor driving the auxiliary pumping means is adjusted on the basis of the acceleration of the vehicle using an oscillating lever that adjusts the number of revolutions of a propulsion engine of the boat, to which a sensor for the position of the lever is associated. That generates a signal corresponding to its position and to the acceleration condition of the propulsion engine. The signal is transmitted to the controller, which generates a further signal setting/changing the number of revolutions of the motor driving the auxiliary pump which is defined depending on the angular position of the acceleration lever and/or number of revolutions.

Thus, it is possible to set the controller such that the signal sent by it to the control unit of the motor and concerning the change/setting of the number of revolutions is proportional to the number of revolutions of the propulsion engine of the vehicle where the device of the present invention is provided.

In still another embodiment an electronic speed indicator may be provided for the number of revolutions of the vehicle propulsion engine, which has an output for an electric signal corresponding to the detected number of revolutions. The signal is transmitted to the controller that in turn generates a signal controlling the number of revolutions of the motor of the auxiliary pump, which is defined on the basis of said angular position of the acceleration lever and/or of the number of revolutions.

The invention relates also to other features that further improve the above steering system, which are the subject of the dependent claims.

BRIEF DESCRIPTION OF THE DRAWINGS

These and other characteristics and advantages of the present invention will be clearer from the following description of some embodiments shown in enclosed drawings, wherein.

DETAILED DESCRIPTION OF EMBODIMENTS OF THE INVENTION

Figure 1:
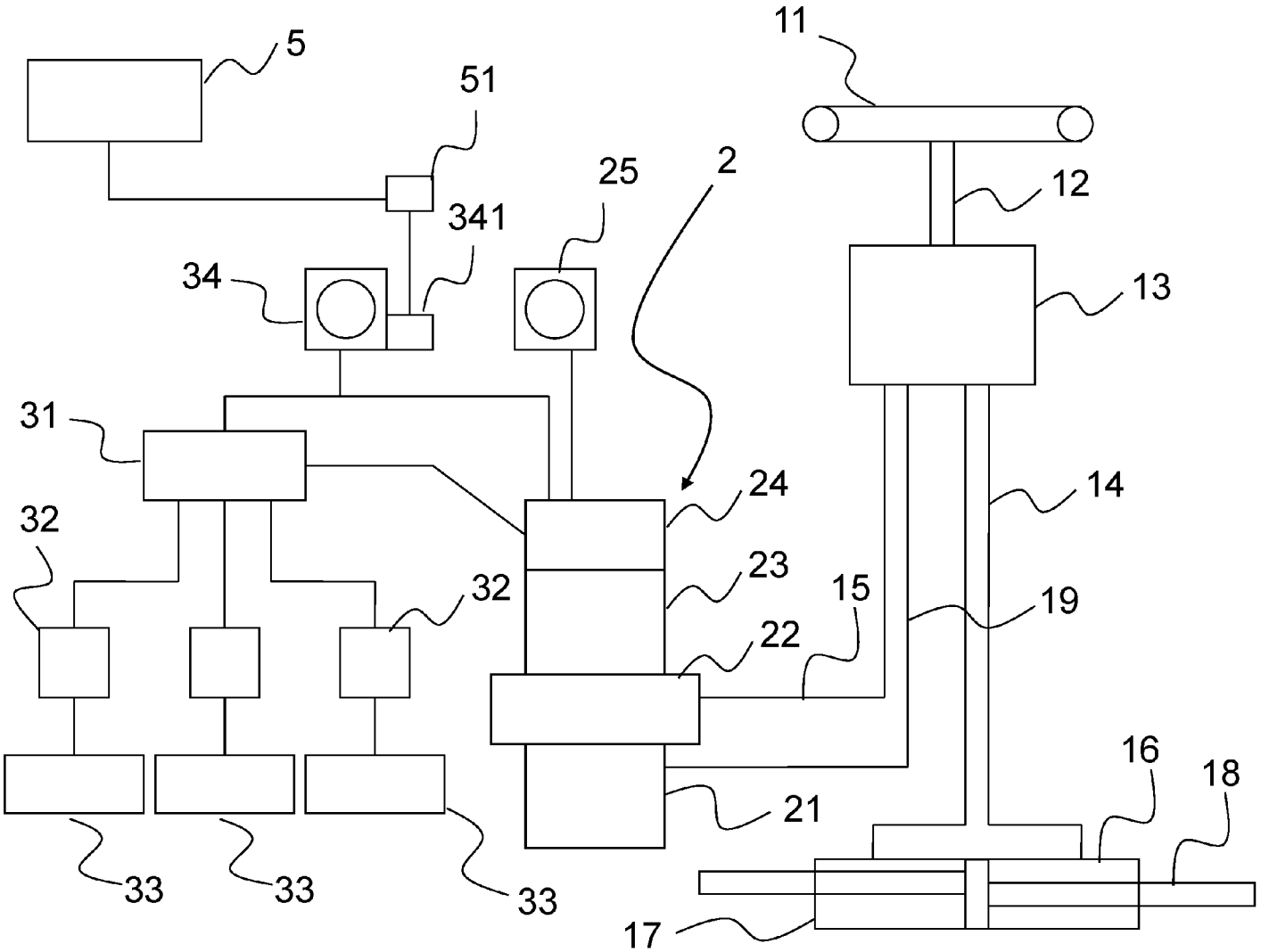
FIG. 1 is a schematic diagram of a servo-assisted steering device for vehicles, in particular for boats or the like, according to one embodiment of the present invention.

FIG. 1 shows a servo-assisted steering device according to the present invention, which includes a manual control member, the steering wheel 11, connected to a shaft 12 driving a manual pump 13. The manual pump 13 is connected with its delivery and suction side to one of the two chambers 16 and 17 respectively of a double acting hydraulic cylinder 18 by means of hydraulic pipes 14. The manual pump 13 is operated when the steering wheel 11 is rotated and, depending on the direction of rotation, feeds a pressurized fluid alternately to the two chambers 16 and 17 of the linear actuator 18, by means of the hydraulic pipes 14.

In particular, the manual pump 13 can be a manually operated piston pump, such as that described in SV2005A000011, that is, a manual pump with a driving shaft rotatably fitted into an housing case; a rotor rotatably integral with the driving shaft, having a plurality of axial compression chambers, each of which houses a piston urged by spring means against a cam track; a distribution cylinder projecting inside a coaxial central hole of the rotor and provided with at least two ducts for the passage of the pressurized fluid, alternately communicating with suction/exhaust ducts of the compression chambers, wherein the distribution cylinder is stationary. The distribution cylinder is made as a separate structural part from the bottom closing the housing case and is removably secured thereto with screw fastening means or the like.

As an alternative, the manual pump 13 can be a gerotor pump, such as that described in SV2002A000031, that is, a pump having an outer rotor and an inner rotor. The inner rotor has a plurality of peripheral notches with a curved configuration and identical to one another, preferably in the form of circular sector, which form projecting tooth-like elements therebetween. The outer rotor has a peripheral wall with a configuration complementary to the notches and to the teeth of the inner rotor, forming a plurality of notches complementary to the tooth elements of the inner rotor. The outer rotor has a number of notches for the tooth elements of the inner rotor equal to the number of the tooth elements of the inner rotor plus at least a further notch. The inner rotor rotates inside the outer rotor about an axis parallel to that of the outer rotor but radially offset with respect to it and it rotatably drives the outer rotor that rotates into a circular housing seat.

Moreover, the manual pump 13 is connected to assist control means 2 by means of hydraulic connection pipes 15 and 19, in particular the pipe 19 provides communication between the manual pump 13 and a pressurized fluid tank 21, while the pipe 15 provides communication between the manual pump 13 and an automatic powered pump 22. The automatic pump 22 is driven by an electric motor 23 to which a control unit 24 is connected allowing the number of revolutions of the motor 23 to be modified. Such control unit 24 modifies the number of revolutions, and consequently the delivered power, of the motor 23 on the basis of setting/changing signals generated by the potentiometer 25 which is manually operated.

The fact that it is possible to change the number of revolutions of the motor 23, and consequently, by operating the automatic mechanical pump 22, to have the assist control means 2 allow the amount of fluid pumped into one of the two chambers 16 and 17 to be increased, facilitates the steering action, reducing the resistance when steering the steering wheel 11.

Again with reference to FIG. 1, the control unit 24 is connected not only to the potentiometer 25, but also to a controller 31. The controller 31 allows the number of revolutions of the motor 23 to change, by means of the control unit 24, on the basis of navigation parameters. The controller 31 is connected to means setting navigation parameters, composed of mechanical members 33 provided in combination with sensors 32, which read the operating conditions of the mechanical members 33 and translate such operating conditions into electric signals that are supplied to the controller 31.

The controller 31 processes such electric signals and therefore, on the basis of the operating conditions of the mechanical members 33, sets the number of revolutions of the motor 23 by means of the control unit 24. The controller 31 is advantageously provided with processor means executing a logic program for processing the signals from sensors 32, such to generate different correlation functions for the signals transmitted from sensors 32 and the signals changing/setting the number of revolutions of the motor 23. In particular, the processing program gives a "weighting" coefficient to input signals and, consequently, an order of importance thereto.

In FIG. 1 there are provided power supply means for the entire system, which are composed of a power generating and storing source, such as battery or the like 5, and of matching circuits for the communication between the power generating and storing source 5 and the controller 31 and control unit 24.

Moreover, there is provided a cutoff device 51 opening and closing the electric circuit for the connection between the battery 5 and the control unit 24 and the controller 31.

Again with reference to FIG. 1, the controller 31 and the control unit 24 are connected to means operating/disabling the control unit and the controller, which preferably include at least a push button switch 34, placed between the power cutoff device 51, the control unit 24 and the controller 31. The push button switch 34 has two conditions, an operating condition and a disabling condition, and an electronic control unit 341, such that the control unit 24 and the controller 31 are operated or disabled on the basis of the operating/disabling condition of the push button switch 34.

The operating/disabling condition of the push button switch 34 is defined by the control electronics 341 controlling the opening or closure of the power supply circuit and, in the case of closed power supply circuit, allows the switch 34 to be operated by a manual control.

Advantageously, if there is no power supply, the control electronics 341 automatically set the push button switch 34 in the disabling condition even without the manual control.

In particular, the use of the manual control of the lever type 26 acting on the potentiometer 25, which in turn controls the control unit 24 to change the number of revolutions of the motor 23, automatically leads to the disabling condition of the push button switch 34.

There can be further provided means for operating the power supply of the motor 23 and of the controller 31 in a minimum consumption condition, where the electric controller 31 produces a signal changing/setting the number of revolutions of said motor 23, which corresponds to a minimum number of revolutions that guarantees an initial steering assist level, while upon operation by a manual control switching the push button 34, the controller 31 produces a signal changing/setting the number of revolutions of the motor 23, corresponding to a greater number of revolutions and guaranteeing a higher steering assist level with respect to the minimum number of revolutions. The electric controller 31 is operated contemporaneously with the generation of signals changing/setting the number of revolutions of the motor 23 on the basis of the signals transmitted from the one or more sensors of one or more control members.

A variant embodiment of the device shown in FIG. 1 provides an oscillating lever to be used for setting the number of revolutions of the propulsion engine of the boat, to which a sensor for the position of said lever is associated, which generates a signal corresponding to the position and to the acceleration condition of the propulsion engine. Such a signal is transmitted to the controller 31, in turn generating a control signal changing/setting the number of revolutions of the motor 23, which is defined on the basis of the angular position of the acceleration lever or of the number of revolutions. For example, the signal changing/setting the number of revolutions of the motor 23 can be proportional to the number of revolutions relative to the propulsion engine of the boat. In this case it is possible to provide an electronic speed indicator (not shown in FIG. 1) of the propulsion engine, which receives an input signal about the angular position of the acceleration lever and/or about the number of revolutions of the propulsion engine and communicates an output signal to the controller 31, such that the controller can send a signal changing/setting the number of revolutions of the motor 23.

The signal changing/setting the number of revolutions can be set by means of manual control members intended for such function that actively or passively modify a command setting/changing the number of revolutions supplied to the central unit 24, which in turn generates the corresponding signal for powering the motor 23.

When the central unit 24 can receive control signals for setting/changing the number of revolutions of the motor 23 from several different generating units, for example from the manual units and from those combined with commands of other navigation parameters as described above, then, in addition to the weighting criterion, priority criteria may be provided for transmitting/accepting control signals generated from the different units. There can be several methods for determining this as known to a person skilled in the art. An example can be to associate to the commands an identification code of the unit generating the control signal. The code is read by the central unit, which on the basis of a stored priority table intercepts and stops control signals from units having a low priority while accepting the control signal generated from the unit that has the highest priority from time to time.

This constructional method should not be considered as a limitation, but only a possible embodiment of the priority criteria. The same method can be used also for associating, to control signals from the several generating units, different weights for defining a control signal on the basis of the combination of all the signals from all the control units.

It should be noted also that because navigation parameters that can affect the change of the number of revolutions of the motor 23 driving the pump 22, the number of propulsion engines operating when the boat is provided with two or more engines and/or even the intensity of the current generated from the alternators of such operating propulsion engine can also be considered.

By use of the invention it is possible, for example, to change current consumption without completely abolishing the assistance of the pump to the steering operations when the boat is driven with a low number of revolutions or with a reduced number of motors. This condition is, for example, applied when the boat is used for fishing, or in the event of maneuvering, or when scanning the seabead, substantially when the cruising speed and therefore the number of revolutions and the amount of current generated from the motors is low.

Figure 2:
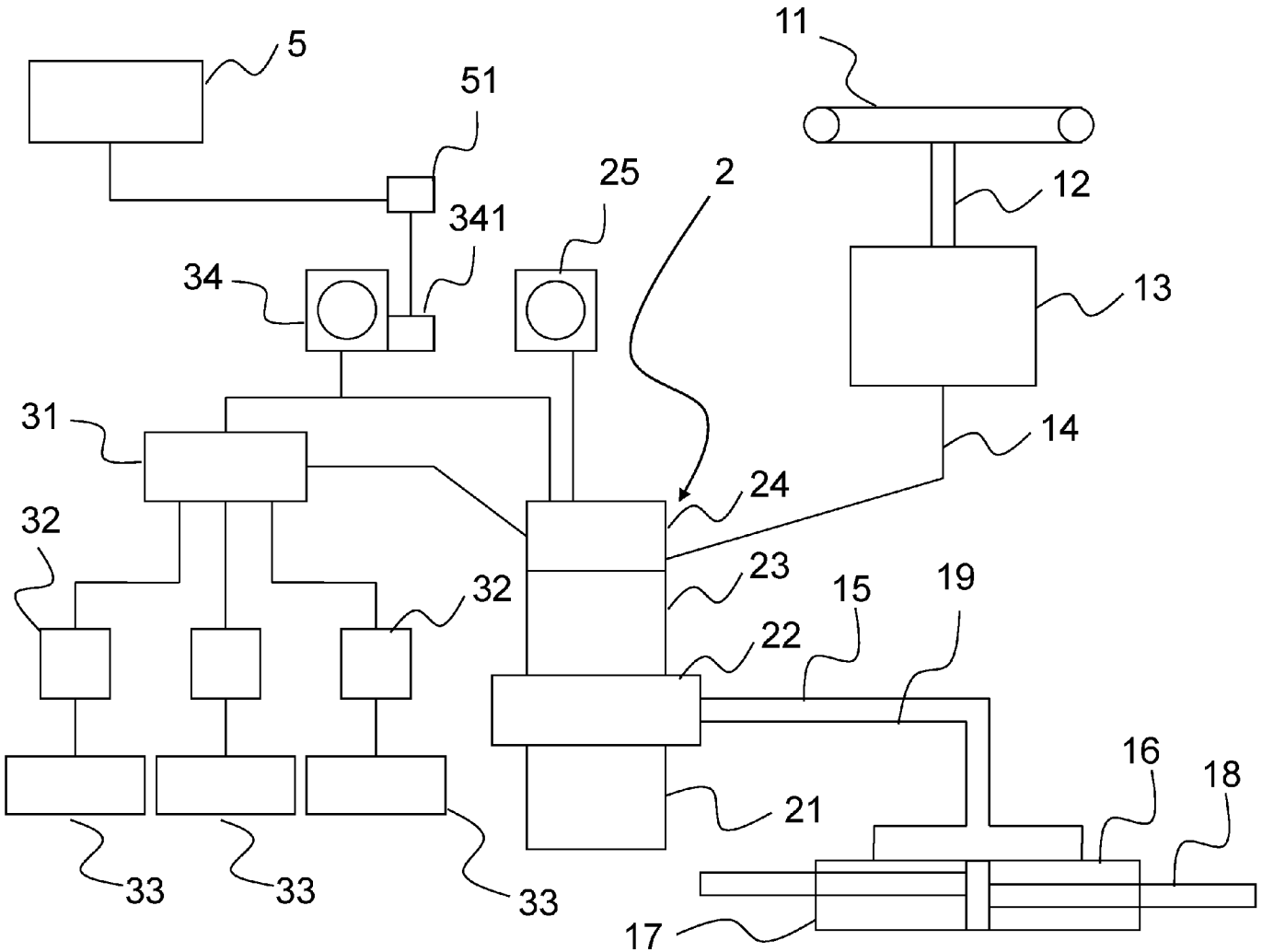
FIG. 2 is a schematic diagram of a servo-assisted steering device for vehicles, in particular for boats or the like, according to a variant embodiment of the present invention.

FIG. 2 shows the servo-assisted steering device of the present invention according to a possible variant embodiment. Such device is composed of a manual control member, the steering wheel 11, connected, by its driving shaft 12 to conversion means 13, which are operated by the driving shaft 12 and which, transform, the rotational movement of the steering wheel 11 into electric signals corresponding to the direction and rotation angle of the driving shaft 12 of the steering wheel 11 and/or of the control member.

In this case, the conversion means 13 are electronically connected, by the line 14, to the control unit 24, previously described, of the assist control means 2, which control unit 24 receives input electric signals sent from conversion means 13. On the basis of those signals, the unit 24 sets the number of revolutions of the motor 23, which drive the previously described automatic powered pump 22 that communicates with a tank 23.

Through hydraulic pipes 15 and 19, the automatic pump 22 is connected at its delivery and suction side to one of the two chambers 16, 17 respectively of a double-acting hydraulic cylinder 18. Depending on the direction of rotation of the control member 11, through said hydraulic pipes 15 and 19, the automatic pump 22 feeds a pressurized fluid contained in the tank 23 alternately to the two chambers of the double-acting cylinder 18.

Since output signals from the conversion means 13 depend on the rotation of the control member 11, consequently the control unit 24 sets the number of revolutions of the motor 23 on the basis of the level of rotation of the steering wheel 11.

Preferably, the conversion means 13 comprise a sensor which transforms the rotational movement of the control member 11 into electric signals to be sent to a digital electronic component, such as an encoder or the like, which converts said electric signals into digital data to be sent to the control unit 24.

Because the number of revolutions of the motor 23 can be changed, and consequently by driving the automatic mechanical pump 22, the assist control means 2 allow the amount of fluid pumped into one of the two chambers 16 and 17 to be set such that the steering action of the steering wheel 11 is facilitated.

As described above, such control unit 24 modifies the number of revolutions, and consequently the delivered power, of the motor 23 not only on the basis of the data received from the conversion unit 13, but also on the basis of setting/changing signals generated from the potentiometer 25, which is in turn controlled by a manual control such as a lever 26.

Again with reference to FIG. 2, the control unit 24 is connected not only to the potentiometer 25, but also to a controller 31, which allows the number of revolutions of the motor 23 to be modified by the control unit 24 on the basis of navigation parameters.

The operation of the controller 31 and of all the other devices connected thereto has the same characteristics which were described above at length.

All the variant embodiments described for FIG. 1 and related to the controller 31 and to all devices connected thereto are an integral part of the variant embodiment of FIG. 2.

In particular, for the variant embodiment described in FIG. 2, the controller 31 is advantageously provided with processor means executing a logic program that processes signals from sensors 32, such to generate different correlation functions for signals transmitted from sensors 32 and signals changing/setting the number of revolutions of the motor 23 sent to the control unit 24 both from the potentiometer 25 and from the conversion unit 13. In particular, such processing program gives a "weighting" coefficient to the input signals, and consequently, an order of importance thereto.

What has been described with reference to the first embodiment of FIG. 1 in regard to priority criteria for processing/accepting control signals changing/setting the number of revolutions of the motor 23 driving the pump 22 is also applicable to the present embodiment.

Finally, it should be noted that two different types of motors can be used having different costs and different functional advantages. A person skilled in the art will appreciate that the unit 24 will be different depending on the type of motor in use.

Another embodiment provides for the use of brushless motors. In this case the electronics are the conventional electronics used for these motors. The technical advantages are partially compensated by the greater cost, which is due also to having the unit 24 custom-made.

As an alternative, it is possible to use conventional brush motors. In this case the unit 24 is preferably a modulator, which modulates the direct current power signal according to a method called Pulse Width Modulation (PWM), which is widely known in the art of the power signal modulation.

The advantage of this embodiment is the relatively inexpensive cost, and requiring very simple and conventional electronics, and therefore to be very strong and reliable, which is much appreciated in the marine field. Moreover, both the motor and the electronic components have an easy and very wide availability and, therefore, maintenance and repairing operations are inexpensive and also simple.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become obvious to those skilled in the art and the scope of the present invention is limited only by the appended claims.

The invention claimed is:

1. A servo-assisted steering device for a marine vehicle comprising:

a manual control member connected to a shaft, the shaft driving a conversion unit when the control member is rotated, the conversion unit having a delivery and suction side connected to one of two chambers respectively of one or more steering actuators through hydraulic pipes to feed a pressurized fluid alternately either to one or the other of the two chambers of the one or more steering actuators depending on moving direction of the manual control member;

an assist control system for the one or more steering actuators, the assist control system being also connected to the hydraulic pipes, the assist control system comprising a hydraulic fluid tank and an automatic pump which is driven by a driving motor, the assist control system providing the pressurized fluid to the hydraulic pipes when the steering wheel is operated, the automatic pump increasing an amount of pumped fluid, and one or more of a pressure exerted by the conversion unit or a flow rate of the pumped fluid, thereby reducing resistance when steering the manual control member; and a system setting/changing a number of revolutions per minute of the driving motor driving the automatic pump, the system setting/changing the number of revolutions per minute controlling or modifying the number of revolutions per minute of the driving motor based on changes in operating conditions of mechanical members of the marine vehicle, wherein the system setting/changing the number of revolutions per minute of the driving motor comprise an active or passive element generating a command setting/changing the number of revolutions per minute of the driving motor, the active or passive element being manually operated.

2. The device according to claim 1, wherein the system setting/changing the number of revolutions per minute of the driving motor comprises a member to manually enter a command setting/changing the number of revolutions per minute of the driving motor and a control unit generating power supply signals for the driving motor, which correspond to an entered command setting/changing the number of revolutions per minute of the driving motor.

3. The device according claim 2, wherein the conversion unit transforms a rotational movement of the control member into electric signals, the conversion unit being electrically connected to the control unit and comprising a sensor and a digital electronic component, and wherein the sensor transforms the rotational movement of the control member into the electric signals to be sent to the digital electronic component that converts the electric signals into digital data to be sent to the control unit.

4. The device according to claim 2, wherein the number of revolutions per minute of the automatic pump is set based on navigation parameters, further comprising a unit setting the navigation parameters, communicating with a controller that generates commands changing/setting the number of revolutions per minute of the motor of the automatic pump, the commands being sent to the control unit in combination with or in alternative to commands generated by a manual setting/changing device.

5. The device according to claim 4, further comprising a unit setting priority criteria among the commands setting/changing the number of revolutions per minute of the motor of the automatic pump generated from the manual setting/changing device and the commands generated from the controller, the control unit verifying the set priority criteria and for accepting/stopping commands based on priority of the commands.

6. The device according to claim 4, wherein the unit setting navigation parameters comprise mechanical members that are provided in combination with one or more sensors reading operating conditions of the mechanical members and generating electric signals corresponding to the operating conditions, the one or more sensors being connected to the controller, and wherein the navigation parameters comprise navigation conditions settable by a user selecting one or more of a setting signal, navigation conditions detected by one or more sensors connected to one or more operating propulsion engines, a number of revolutions per minute of the one or more operating propulsion engine, or electric current generated by alternators of the one or more operating propulsion engines.

7. The device according to claim 4, further comprising:

a power supply unit comprising a power generating and storing source and a circuit matching and connecting the power generating and storing source to the control unit and to the controller; and a manually operated cutoff device configured to open or close the circuit connecting the source, the control unit, and the controller.

8. The device according to claim 7, further comprising a device operating/disabling the control unit and the controller, the operating/disabling device comprising a push button switch having two conditions, one of the two conditions being an operating condition and the other of the two conditions being is a disabling condition, the push button switch having an electronic control unit and being placed between the cutoff device, the control unit, and the controller, the control unit and the controller being operated or disabled depending on an operating/disabling condition of the push button respectively, the push button passing from the operating condition to the disabling condition through a manual control, the disabling condition of the push button switch being automatically set even without the manual control when the electronic control unit detects an interruption of power supply by the cutoff device.

9. The device according to claim 8, wherein the controller operated by the push button receives at least one input parameter of the navigation from one or more sensors, processes the at least one input parameter and sends to the control unit of the driving motor a signal identifying a power amount/number of revolutions per minute that the driving motor is to deliver to the automatic pump, the controller having a processor executing a logic program processing signals from the one or more sensors and giving a weighting coefficient to parameter values of input signals such to provide an order of importance thereto and consequently set a power level to be delivered by the driving motor, the processor generating a signal changing/setting one or more of the number of revolutions per minute of the driving motor or the power delivered by the driving motor based on one or more different correlation functions for signals transmitted from the one or more sensors and signals setting/changing the number of revolutions per minute of the driving motor or the power delivered by the driving motor.

10. The device according to claim 9, wherein the signal changing/setting the number of revolutions per minute by a manual control automatically sets the push button switch to the disabling condition.

11. The device according to claim 9, further comprising a device operating the auxiliary power supply of the driving motor and of the controller in a condition of minimum consumption, the controller generating a signal changing/setting the number of revolutions per minute of the driving motor which corresponds to a minimum number of revolutions per minute providing an initial steering assist level, wherein, upon operation by a manual control switching the push button, the controller generates the signal changing/setting the number of revolutions per minute of the driving motor which corresponds to a greater number of revolutions per minute and provides a higher steering assist level with respect to the minimum number of revolutions per minute, the controller being operated contemporaneously with a generation of signals changing/setting the number of revolutions per minute of the motor based on signals transmitted by one or more sensors of the manual control member.

12. The device according to claim 1, further comprising an oscillating lever adjusting a number of revolutions per minute of a propulsion engine of the boat, to which a sensor for a position of the lever is associated, the sensor generating a signal which corresponds to position and to acceleration condition of the propulsion engine, the signal being transmitted to the controller that generates a signal controlling the number of revolutions per minute of the driving motor, which is defined depending on an angular position of an acceleration lever or the number of revolutions per minute of the propulsion engine.

13. The device according to claim 12, wherein the signal changing/setting the number of revolutions per minute of the driving motor is directly proportional to the number of revolutions per minute of the propulsion engine.

14. The device according to claim 12, further comprising an electronic speed indicator for the number of revolutions per minute of the propulsion engine, the electronic speed indicator having an output for an electric signal corresponding to a detected number of revolutions per minute, the electric signal being transmitted to the controller which generates a signal controlling the number of revolutions per minute of the driving motor, which is defined based on the angular position of the acceleration lever or of the number of revolutions per minute of the propulsion engine.

* * * * *